US005784681A

United States Patent [19]

Purnell et al.

[11] Patent Number: 5,784,681

[45] Date of Patent: Jul. 21, 1998

[54] METHOD OF MAKING A SINTERED ARTICLE

[75] Inventors: Charles Grant Purnell, Coventry; Leslie John Farthing, Rugby; David Holme, Newton, all of United Kingdom

[73] Assignee: Brico Engineering Limited, Coventry, England

[21] Appl. No.: 716,248

[22] PCT Filed: Mar. 16, 1995

[86] PCT No.: PCT/GB95/00571

§ 371 Date: Sep. 13, 1996

§ 102(e) Date: Sep. 13, 1996

[87] PCT Pub. No.: WO95/26421

PCT Pub. Date: Oct. 5, 1995

[30] Foreign Application Priority Data

Mar. 25, 1994 [GB] United Kingdom ..... 9405946

[51] Int. Cl.[6] ..... B22F 3/10

[52] U.S. Cl. ..... 419/11; 419/14; 419/15; 419/36; 419/38; 419/53; 419/58; 75/236; 75/246; 75/950

[58] Field of Search ..... 419/11, 14, 15, 419/36, 38, 53, 58; 75/236, 246, 950

[56] References Cited

U.S. PATENT DOCUMENTS

| | | | |
|---|---|---|---|
| 4,909,843 | 3/1990 | Leithner | 75/237 |
| 4,970,049 | 11/1990 | Baker et al. | |
| 4,985,309 | 1/1991 | Ogura et al. | 428/570 |
| 5,009,842 | 4/1991 | Hendrickson et al. | 419/28 |
| 5,356,453 | 10/1994 | Takata | 75/244 |
| 5,403,371 | 4/1995 | Engdahl et al. | 75/230 |
| 5,462,573 | 10/1995 | Baker et al. | 75/231 |
| 5,498,483 | 3/1996 | Ito et al. | 428/552 |
| 5,522,914 | 6/1996 | Stasko et al. | 75/231 |
| 5,571,305 | 11/1996 | Uenosono et al. | 75/246 |

*Primary Examiner*—Daniel J. Jenkins

*Attorney, Agent, or Firm*—Synnestvedt & Lechner

[57] ABSTRACT

A method of making a sintered article is disclosed, the method comprising the steps of mixing a prealloyed ferrous powder having a composition in the following ranges in weight %: carbon 0.7-2.7/chromium 3-6/cobalt 5-10/vanadium 0.5-3/molybdenum 6-11/silicon 0.3-2/ others total 2 max/balance iron and optionally up to 3 wt % tungsten, with an addition of carbon powder of at least 0.1 wt %, compacting said powder mixture by uniaxial pressing to form a green compact of near net shape, sintering said green compact in a continuous gas atmosphere sintering furnace at a temperature in the range from 1130° C. to 1250° C. such that the final density of said sintered material is greater than 95% of the theoretical density as a result of the sintering operation alone.

19 Claims, 4 Drawing Sheets

METHOD OF MAKING A SINTERED ARTICLE

FIELD OF THE INVENTION

The present invention relates to a method of making a sintered article particularly, though not exclusively, a valve seat insert for heavy-duty applications in internal combustion engines.

BACKGROUND OF THE INVENTION

It is well known to produce valve seat inserts for applications in gasoline engines by a powder metallurgy route. Frequently, a ferrous powder mixture comprising a prealloyed ferrous powder and various additives is pressed uniaxially to about 80% of its theoretical density, sintered and often infiltrated to fill the residual porosity with copper. The materials used, usually medium-alloy steels or high speed steels, may be diluted with relatively high proportions of iron powder to assist compressibility and to lessen stresses on the press tools. Where such dilution is used, densities of up to 85% of theoretical may be achieved. The valve seat inserts so produced are generally used in low to medium-duty applications.

Conventionally, valve seat inserts for heavy-duty applications such as in large diesel engines such as are used in truck, marine, industrial and generator set applications, for example, have been produced by casting. The alloys used have been cobalt-, nickel- or iron -based materials. In premium heavy duty applications cobalt-rich alloys such as Stellite (trade mark) have been favoured. However, cobalt is both an expensive and a strategic material and its cost has been rising rapidly over recent years to levels which restrict its economic viability for valve seat insert applications.

Cast valve seat inserts rely for their performance in respect of wear and abrasion resistance on the formation during solidification of hard carbide phases. However, such hard phases tend to be gross in nature and relatively inhomogeneous in distribution when produced by the cast route. This is a disadvantage in what is essentially a component of low cross-sectional area, leading to a lack of fracture toughness. A further disadvantage of such materials having gross hard carbides is their poor machinability and poor compatibility with valve materials.

GB-A-2 187 757 describes a sintered iron-based material which, amongst other uses is stated as being suitable for valve seats.

The material described utilises a relatively high boron content to promote liquid phase sintering to thereby encourage some degree of densification during sintering. However, the use of boron as an aid to densification makes the material extremely critical to sintering temperature in respect of uniformity of shrinkage and distortion during sintering. It is common practice with such boron containing materials to sinter them under vacuum conditions in suitable furnaces, thus increasing the cost of production. Furthermore, although reference is made to the use of the materials described as valve seats, the entire thrust of the reference is concerned with the wear resistance of parts in sliding contact with each other rather than by impact contact as is the case with valve seat inserts and co-operating valves. It is also stated in this reference that the sintered alloys described preferably have a theoretical density ratio of more than 90%.

Phosphorus is also similarly employed to promote liquid phase sintering and also suffers from similar disadvantages.

SUMMARY AND OBJECTS OF THE INVENTION

It is an object of the present invention to produce a sintered, high-density valve seat insert suitable for heavy-duty applications and a method for the production of such a valve seat insert.

It is a further object of the present invention to enable the valve seat insert to be produced, and the method for its production to be carried out, on conventional production plant equipment in order for the production of such a valve seat insert to be cost effective. Such plant may include conventional uniaxial compacting presses and compacting tools operating at pressures up to about 770 MPa; conventional conveyor, walking beam furnaces, or batch furnaces employing protective gas atmospheres to maintain a reducing atmosphere or one of controlled carbon potential.

It is a yet further object to produce a sintered valve seat insert for premium heavy-duty applications, which employs ferrous based materials containing less cobalt than known cast valve seat inserts such as Stellite (trade mark), and which have not previously been accessible to volume production sintered valve seat insert materials.

It is also a further object to achieve the above objectives without the use of boron or phosphorus as a sintering aid.

According to a first aspect of the present invention, there is provided a method of making a sintered product, the method comprising the steps of mixing a prealloyed ferrous powder having a composition in the following ranges in weight %: carbon 0.7–2.7/chromium 3–6/cobalt 5–10/vanadium 0.5–3/molybdenum 6–11/silicon 0.3–2/ others total 2 max/balance iron and optionally up to 3 wt % tungsten, with an addition of carbon powder of at least 0.1 wt %, compacting said powder mixture by uniaxial pressing to form a green compact, sintering said green compact in a continuous gas atmosphere sintering furnace at a temperature in the range from 1100° C. to 1300° C. such that the final density of said sintered material is greater than 95% of the theoretical density.

Although the present invention is primarily concerned with manufacture of valve seat inserts, the method is equally applicable to the production of parts such as bearing shells, rollers, tappet shims, rocker pads and other articles where high density, high strength and wear resistance are required. Therefore, any reference to valve seat inserts is to be taken as a reference to other appropriate articles.

Preferably, the prealloyed powder contains a minimum of 0.1 wt % tungsten, and more preferably a minimum of 1 wt % tungsten. Preferably, the composition of the prealloyed powder may lie in the ranges in wt %: carbon 0.7–1.6/chromium 3–4.25/cobalt 7.5–8.5/vanadium 1–1.3/tungsten 1–2/molybdenum 9–10/silicon 0.3–1.5/others total 2 max/balance iron.

The preferred range for the total carbon content of the sintered alloy is 1–2.0 wt %. Therefore, sufficient carbon powder, such as graphite for example, may be added to bring the sintered alloy valve seat insert within this range.

It is preferred that a minimum of 0.3 wt % additional carbon powder is used as we have found that this enables the sintering temperature to be reduced in order to achieve the desired minimum density.

The useful maximum addition of free carbon is 0.8 wt % as machinability of the article deteriorates at carbon addition levels above this value due to the formation during sintering of continuous carbide networks in the microstructure.

The addition of free carbon to the powder mixture is effective in increasing the proportion of carbides in the matrix thereby allowing the wear resisting properties to be improved.

The green compact may be an enlarged preform of the final sintered shape.

Preferably, the sintering temperature lies in the range from 1130° C. to 1250° C.

The actual temperature, and sintering time, will depend upon the actual composition and the sintered density which it is desired to achieve, and particularly upon the actual free carbon content of the original powder mixture. It has been found that for a given set of parameters including variables such as required sintered density, composition of the prealloyed powder, sintering time and initial green density, the minimum sintering temperature is inversely related to the initial free carbon content of the powder mixture.

An optional pre-sintering step at temperatures up to 1120° C. may be employed so as, for example, to remove pressing waxes and reduce compounds such as partly hydrolysed manganese sulphide which may be present, manganese sulphide powder being added to the powder mix as a machinability aid.

A particular advantage of the present invention lies in the provision of part of the carbon content by the addition of free carbon to the powder mixture. Such an addition has been found to both reduce the required sintering temperature and to extend the effective sintering temperature range within which effectively full densification is achieved. By the method of the present invention it has been found that a sintering temperature range of about 50° C., within which the desired densification on sintering may be achieved, is available thus allowing more flexibility in the sintering operation and making temperature control within the furnace much less critical.

As has been stated hereinabove, the method of the present invention may be carried out on conventional production plant without the need for expensive and refined techniques and equipment such as vacuum sintering. In particular, it has been found that the method of the present invention may be carried out under readily available, low cost continuous gas atmospheres such as hydrogen and nitrogen mixtures. Such gas atmospheres comprising nitrogen with 5 to 30 volume % of hydrogen have been found to be entirely satisfactory in producing articles of the required high quality, and indeed, have been found in some instances to produce better results than dissociated ammonia which contains 75 volume % of hydrogen and which is also commonly used but somewhat more expensive. In particular, it has been found that the use of gas atmospheres containing only 10 volume % hydrogen compared with dissociated ammonia gave increased density after sintering at temperatures in the range from about 1130° C. to about 1220° C. Conversely, this advantageous effect may be used to reduce the sintering temperature to achieve any given density and may be used to increase the temperature range within which satisfactory sintering may be achieved.

The density of the green compact after initial uniaxial compaction may be restricted to less than 85% of the full theoretical density. This allows compaction pressures which are consistent with those normally employed for uniaxial pressing.

Preferably, the density of the final sintered valve seat insert is greater than about 97% of full theoretical density. However, it should be born in mind that it is very difficult to predict the precise full theoretical density owing to the reactions which occur between the constituents during the sintering process. For example, the addition of carbon as graphite powder does not have the exact effect on density as may be predicted by the appropriate mathematical calculation since the real density will be affected by alloying of the carbon with the other constituents of the pre-alloyed powder with which it is mixed.

A further particular advantage of the present invention is that although a large degree of shrinkage occurs during the sintering step which causes densification to in excess of 95% of full theoretical density from the initial green pressed density of less than 85% of theoretical, such shrinkage has been found to be substantially uniform throughout the sintered body and substantially without distortion as usually occurs with liquid-phase sintering mechanisms such as those generated by the use of boron or phosphorus in the material.

The sintered valve seat insert may be heat treated after sintering to produce a predominantly pearlitic structure having a uniform distribution of free carbides and grain boundary carbides therein. The heat treatment may be an isothermal transformation resulting in a predominantly pearlitic microstructure. Such a structure may be more thermally stable than a martensitic microstructure for example, to give increased stability against high temperature to the microstructure of about an additional 100° C.

The method of the present invention may also include the step of adding a reactive sintering aid to the powder mixture to form in the sintered material a constituent to improve machinability and possibly also endow the material with self-lubricating properties. As set out in co-pending International patent application number PCT/GB93/00380 of common ownership herewith, the content of which is included herein by reference, such additions may include one or more alkaline earth metal carbonates and a sulphur donating material such as molybdenum disulphide. The carbonate reacts during sintering with the molybdenum disulphide to form, for example, magnesium and/or calcium sulphide particles to improve machinability, whilst any excess of the molybdenum disulphide remains as a solid lubricant dispersed throughout the structure. The molybdenum released from the disulphide diffuses into the structure to improve properties.

Alternatively, the powder mixture may include additions of compounds to improve machinability of the sintered material. Such additions may include, for example, high purity manganese sulphide.

It has been found that the powder metallurgy route compared with the cast route enables a valve seat insert, for example, to be produced having a much more uniform and refined structure free from the shrinkage porosity implicit in the casting route, with greater control over the size and distribution of the phases. Furthermore, due to the virtual absence of porosity typical of lower density powder metallurgy parts and the improved size and distribution of the hard carbide phases, machinability of valve seat inserts according to the present invention is greatly improved. Machinability may be also be further improved by the addition of carefully controlled phases specifically intended to enhance machinability as set out above.

According to a second aspect of the present invention there is provided a sintered iron-based alloy article when made by the method of the first aspect of the present invention, the article having a composition lying in the ranges in weight % of: carbon 0.8–3/chromium 3–6/cobalt 5–10/vanadium 0.5–3/molybdenum 6–11/silicon 0.3–2/others total 2 max/balance iron and optionally up to 3 wt % tungsten, the article having a sintered density of greater than 95% of the alloy's full theoretical density.

In one embodiment of the present invention, the article is a valve seat insert for an internal combustion engine.

Preferably, the composition of the sintered article contains a minimum of 0.1 wt % tungsten.

Preferably, the composition of the sintered article lies in the ranges in weight %: carbon 0.8–2/chromium 3–5/cobalt 6–9/vanadium 0.5–2.5/tungsten 0.5–2.5/molybdenum 7–10/silicon 0.3–1.5/ others total 2 max/balance iron.

Most preferably, the sintered article has a composition lying in the ranges in weight % of: carbon 1–2.0/chromium 3–4.25/cobalt 7.5–8.5/vanadium 1–1.3/tungsten 1–2/molybdenum 9–10/silicon 0.3–1.5/ others total 2 max/balance iron.

Preferably, the density of the sintered article is greater than 97% of the full theoretical density.

The microstructure of the article may comprise bainite or martensite but preferably, however, the microstructure may predominantly comprise pearlite.

The hardness of the final article may lie in the range from 20 to 70 HRC dependent on microstructure. Preferably, the hardness of a valve seat may lie in the range from 35 to 45 HRC.

The sintered article of the present invention has a relatively uniform distribution of free carbides compared with cast valve seat structures. The free carbides also have a narrower size distribution compared with cast valve seats. Typically, the free carbides of sintered valve seats according to the present invention may lie in the size range from 1 μm to 10 μm. The free carbides of cast valve seats usually lie in the size range from 5 μm to 40 μm, and generally have a much larger mean size.

BRIEF DESCRIPTION OF DRAWINGS

In order that the present invention may be more fully understood, examples will now be described by way of illustration only with reference to the accompanying drawings, of which.

DETAILED DESCRIPTION OF THE PREFERRED EMBODIMENT OF THE INVENTION

Figure 1:
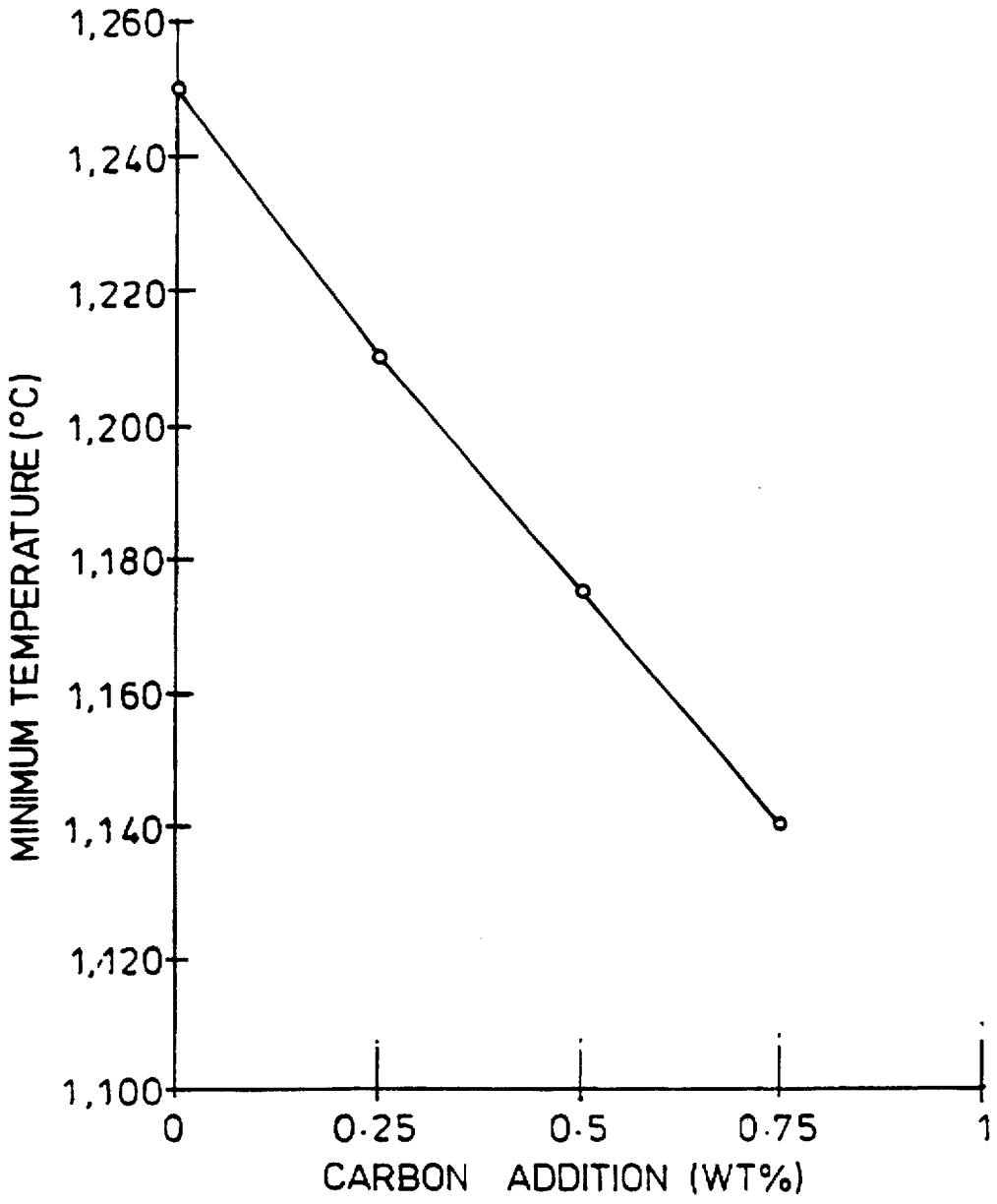
FIG. 1 shows a graph of minimum temperature to sinter to a plateau of density greater than 95% theoretical for compositions made according to the method of the present invention.

An iron-based prealloy powder having the composition in weight %: carbon 1.1/chromium 3.9/cobalt 7.9/vanadium 1.2/tungsten 1.7/molybdenum 9.4/silicon 0.7/balance iron was produced by atomization of a melt, and subsequent annealing to obtain a compressible powder.

EXAMPLE 1

Prealloy powder of the composition described above was mixed with 0.5 wt % carbon and 0.5 wt % manganese sulphide.

EXAMPLE 2

Prealloy powder of the composition described above was mixed with 0.5 wt % carbon and 1 wt % manganese sulphide.

EXAMPLE 3

Prealloy powder of the composition described above was mixed with 0.5 wt % manganese sulphide as a control material to demonstrate the effect of additional carbon powder in Example 1.

EXAMPLE 4

Prealloy powder of the composition described above was mixed with 1 wt % manganese sulphide as a control material to demonstrate the effect of additional carbon powder in Example 2.

EXAMPLE 5

Prealloy powder of the composition described above was mixed with 0.25 wt % carbon of 0.5 wt % manganese sulphide.

EXAMPLE 6

Prealloy powder of the composition described above was mixed with 0.75 wt % carbon and 0.5 wt % manganese sulphide.

All the above Examples were mixed with 1 wt % of a lubricant wax to assist die pressing. Ring shaped samples of nominal size 43 mm O.D. and 29 mm I.D. were pressed at various pressing pressures and sintered at various temperatures under nitrogen plus hydrogen atmospheres in a walking-beam type furnace. Some sintered samples were also heat treated to transform the structure to pearlite or pearlite/bainite structures.

Various tests on the sintered and sintered and heat treated samples were carried out including measurement to assess dimensional control and density, compressive strength as a function of testing temperature, room-temperature hardness and elevated temperature hardness.

The results of the various mechanical and physical property tests are shown in the accompanying Figures.

It may be seen from FIG. 1 that the addition of 0.5 wt % carbon lowers the required sintering temperature by approximately 75° C. to a more practicable level of about 1175° C. The introduction of part of the carbon requirement as a separate addition of graphite powder to the mixed powder also contributes to improved compressibility and to the formation in the matrix of carbides.

Figure 2:
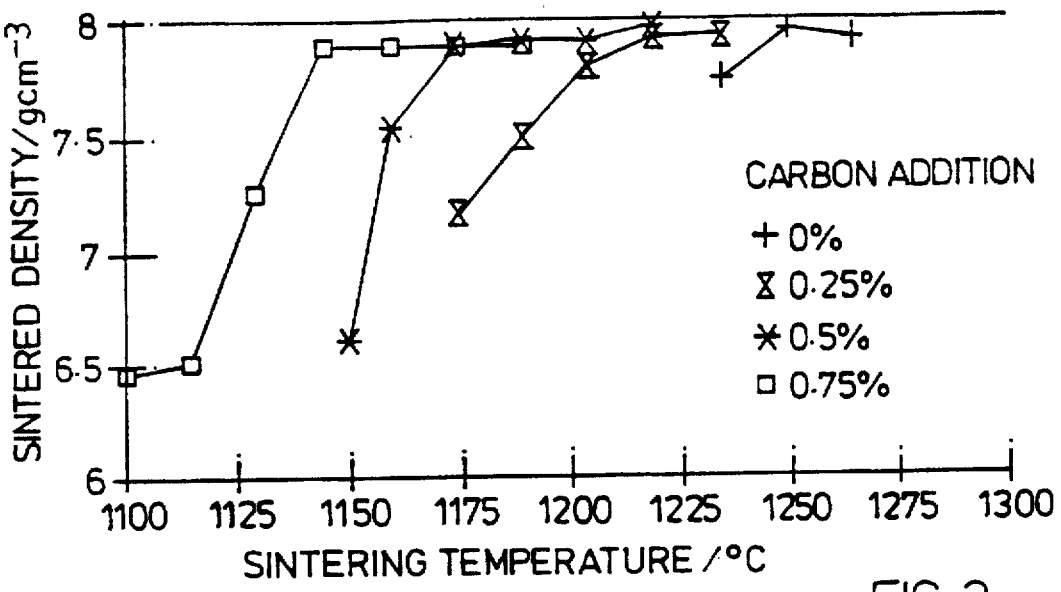
FIG. 2 shows a graph of sintered density vs sintering temperature for valve seat compositions according to the present invention.

FIG. 2 shows the detailed densification curves for the materials made according to Examples 1, 3, 5 and 6. From FIG. 2, the effect of increasing the free carbon addition from zero to 0.75 wt % on sintering temperature to achieve greater than 95% of full theoretical density may be seen. From the graph it may be seen that full densification is achieved at lower sintering temperatures and over a wider range of sintering temperature with increasing free carbon level.

Figure 3:
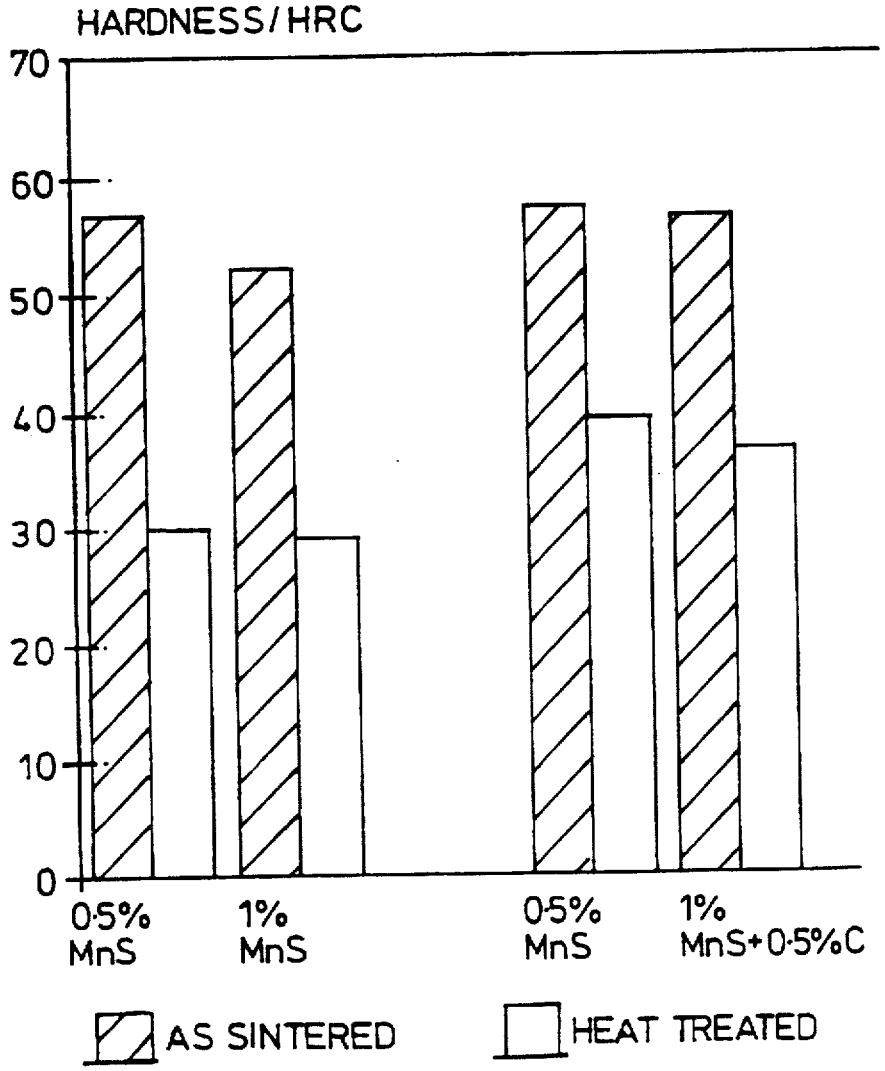
FIG. 3 shows a histogram of room temperature hardness of as-sintered and heat treated valve seats according to the present invention.

FIG. 3 shows a histogram of room-temperature hardness of Examples 1, 2, 3 and 4 in the as-sintered and sintered and heat-treated conditions. As may be seen, the addition of 0.5 wt % carbon significantly improves the room-temperature hardness of the heat-treated material, particularly within the preferred hardness range for valve seat inserts of 35 HRC to 45 HRC. The hardness of the material is reduced by the heat treatment due to the formation of the pearlite structure.

Figure 4:
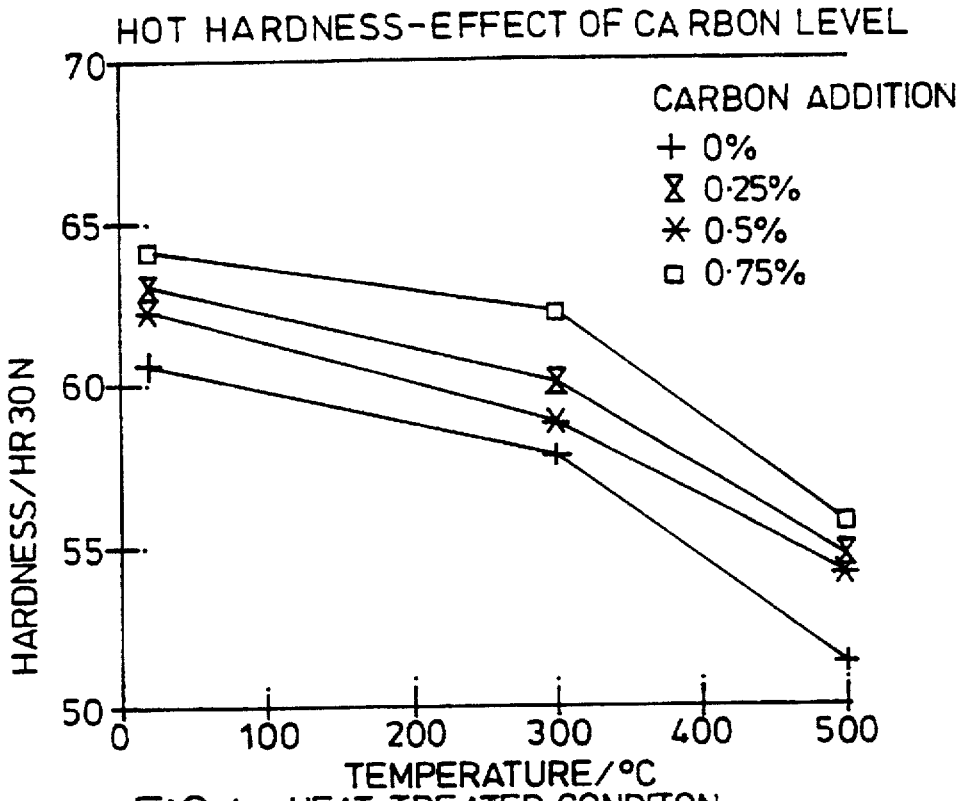
FIG. 4 shows a graph of hardness vs testing temperature for heat treated valve seat material according to the present invention.

FIG. 4 shows hot hardness values for the heat treated Examples 1, 3, 5 and 6 at the stated temperatures. It may be seen that higher hardness levels are maintained by the material having additional carbon and that hardness is maintained at a higher level with increasing additional carbon from between 300° C. and 500° C.

Figure 5:
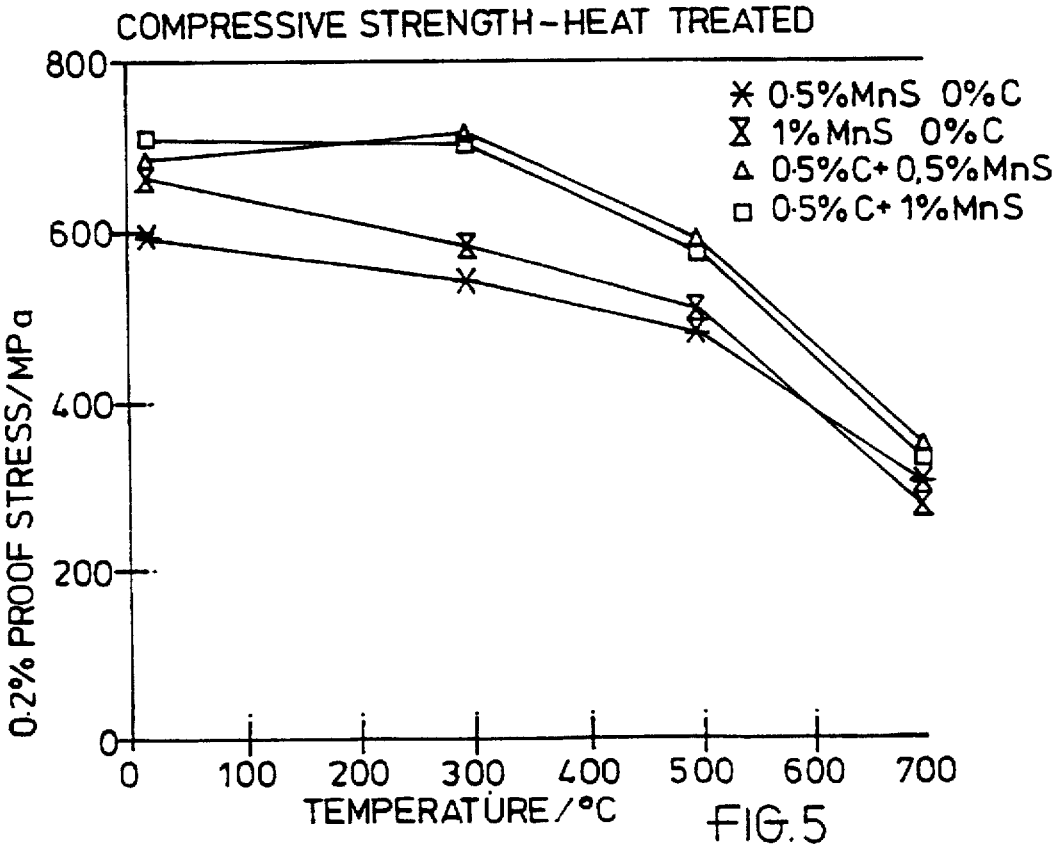
FIG. 5 shows a graph of compressive strength of heat treated material vs testing temperature.

Compressive proof strengths are shown in FIG. 5, the effect of the additional carbon again being to improve the material properties particularly at elevated temperatures.

Figure 6:
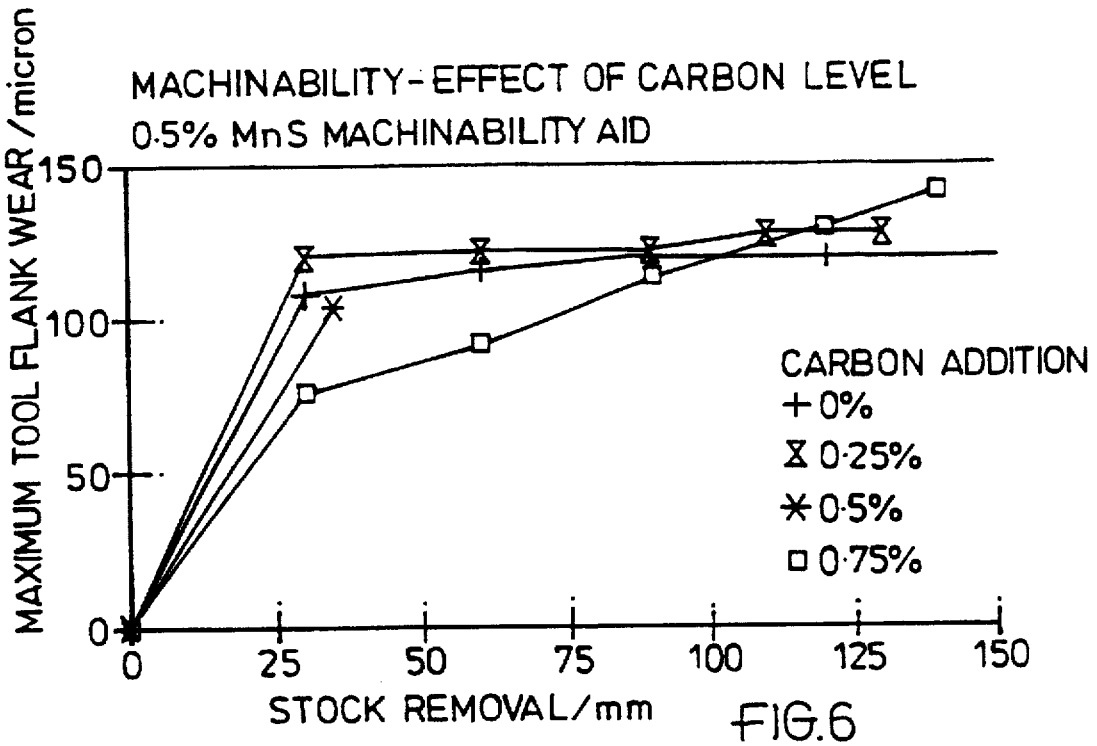
FIG. 6 shows a graph of the effect of free carbon addition on machinability.

FIG. 6 shows the effect of additional carbon on machinability for materials having a constant addition of 0.5 wt % of manganese sulphide.

Figure 7:
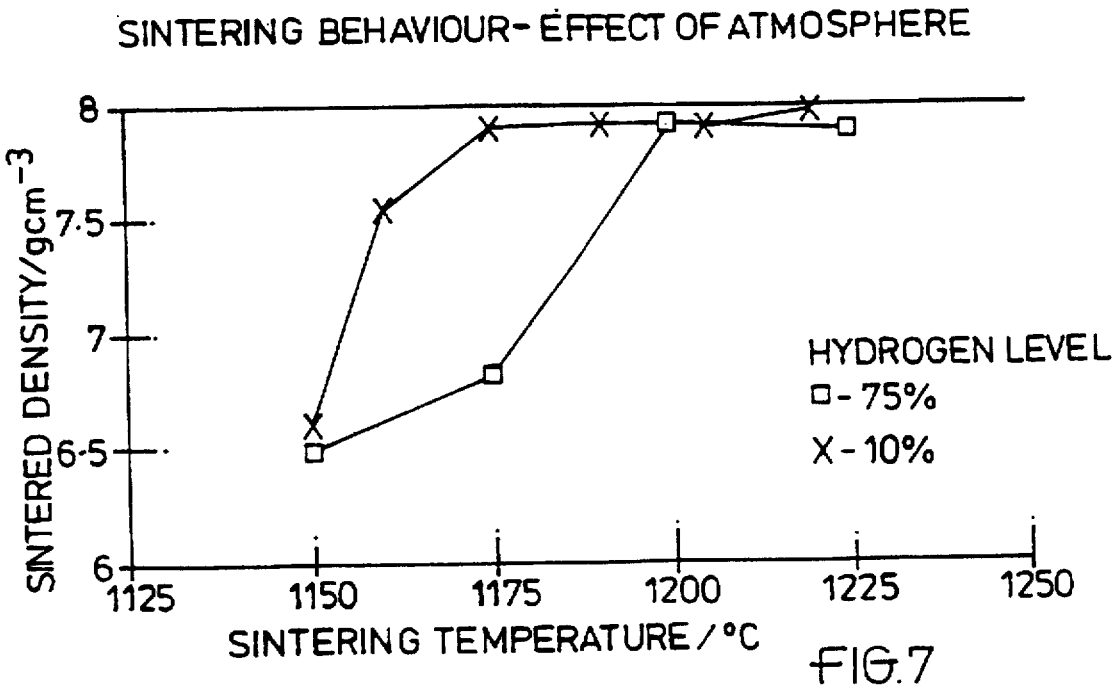
FIG. 7 shows a graph of the effect of sintering gas atmosphere on sintering temperature and density.

FIG. 7 shows the effect on densification during sintering of the material of Example 1 under two different atmospheres having 10 volume % and 75 volume % of hydrogen, respectively. More rapid densification is achieved at lower sintering temperatures for the lower hydrogen atmosphere than under dissociated ammonia.

We claim:

1. A method of making a sintered article, the method comprising the steps of mixing a prealloyed ferrous powder having a composition in the following ranges in weight %: carbon 0.7–2.7 / chromium 3–6 / cobalt 5–10 / vanadium 0.5–3 / molybdenum 6–11 / silicon 0.3–2 / others total 2 max/balance iron and optionally up to 3 wt % of tungsten, with an addition of carbon powder of at least 0.10 wt %, compacting said powder mixture by uniaxial pressing to form a green compact, sintering said green compact in a continuous sintering furnace, having a gas atmosphere, at a temperature in the range from 1130° C. to 1250° C. such that the final density of said sintered material is greater than 95% of the theoretical density as a result of the sintering operation alone.

2. A method according to claim 1 wherein the prealloyed powder contains a minimum of 0.1 wt % tungsten.

3. A method according to claim 1 wherein the composition of the prealloyed powder lies in the ranges in wt %: carbon 0.7–1.6/ chromium 3–4.25/ cobalt 7.5–8.5/ vanadium 1–1.3/ tungsten 1–2/ molybdenum 9–10/silicon 0.3–1.5/ others total 2 max/ balance iron.

4. A method according to claim 1 wherein the total carbon content of the sintered article is 1–2.0 wt %.

5. A method according to claim 1 wherein the powder mixture contains a minimum of 0.3 wt % additional carbon powder.

6. A method according to claim 1 wherein the maximum addition of free carbon is 0.8 wt. %.

7. A method according to claim 1 further including a pre-sintering step at temperatures up to 1120° C.

8. A method according to claim 1 wherein the sintering step is carried out under a continuous gas atmosphere comprising a mixture of hydrogen and nitrogen.

9. A method according to claim 8 wherein said gas atmosphere comprises up to 30 volume % hydrogen.

10. A method according to claim 1 wherein the green density of the article is less than 85% of theoretical.

11. A method according to claim 1 wherein the density of the final sintered article is greater than about 97% of full theoretical density.

12. A method according to claim 1 further including the step of heat treating the article after sintering to produce a predominantly pearlitic structure having a uniform distribution of free carbides therein.

13. A method according to claim 12 wherein the heat treatment is an isothermal heat treatment.

14. A sintered iron-based alloy article when made by claim from 1, the article comprising a composition lying in the ranges in weight % of: carbon 0.8–3/ chromium 3–6/ cobalt 5–10/ vanadium 0.5–3/ molybdenum 6–11/ silicon 0.3–2/ others total 2 max/ balance iron and optionally up to 3 wt % tungsten, the article having a sintered density of greater than 95% of the alloy's full theoretical density.

15. A sintered article according to claim 14 further including a minimum of 0.1 wt % tungsten.

16. A sintered article according to claim 14 wherein the microstructure contains free carbides having a size range from 1 μm to 1 μm.

17. A sintered article according to claim 14.

18. A sintered article according to claim 17 and having a hardness of from 35 HRC to 45 HRC.

19. A sintered article according to claim 14 wherein the sintered article is a valve seat insert for an internal combustion engine.

* * * * *

UNITED STATES PATENT AND TRADEMARK OFFICE

CERTIFICATE OF CORRECTION

PATENT NO. : 5,784,681

DATED : July 21, 1998

INVENTOR(S) : Purnell et al

It is certified that error appears in the above-identified patent and that said Letters Patent is hereby corrected as shown below:

Column 8, line 25, delete "from"

Column 8, line 35, change "1 μm to 1 μm" to --1 μm to 10μm--

Column 8, line 36, after "claim 14" insert --and having a hardness of from 20 HRC to 70 HRC--

Signed and Sealed this

Seventeenth Day of November, 1998

Bruce Lehman

*Attest:*

BRUCE LEHMAN

*Attesting Officer*

*Commissioner of Patents and Trademarks*